US007175475B2

(12) United States Patent
Hanley

(10) Patent No.: US 7,175,475 B2
(45) Date of Patent: Feb. 13, 2007

(54) RECEPTACLE FOR COPPER WIRE TRANSCEIVERS

(75) Inventor: Michael Francis Hanley, Rochester, MN (US)

(73) Assignee: JDS Uniphase Corporation, Milpitas, CA (US)

( * ) Notice: Subject to any disclaimer, the term of this patent is extended or adjusted under 35 U.S.C. 154(b) by 35 days.

(21) Appl. No.: 11/157,558

(22) Filed: Jun. 21, 2005

(65) Prior Publication Data

US 2005/0282436 A1 Dec. 22, 2005

Related U.S. Application Data

(60) Provisional application No. 60/581,525, filed on Jun. 21, 2004.

(51) Int. Cl.
*H01R 13/648* (2006.01)

(52) U.S. Cl. ..... 439/607; 439/79

(58) Field of Classification Search ..... 439/79, 439/95, 607, 76.1

See application file for complete search history.

(56) References Cited

U.S. PATENT DOCUMENTS 6,231,389 B1 * 5/2001 Lai ..... 439/607
6,860,744 B2 * 3/2005 Maruyama et al. ..... 439/79
6,899,551 B1 * 5/2005 Vanbesien ..... 439/79
7,044,752 B2 * 5/2006 Olson et al. ..... 439/79

* cited by examiner

*Primary Examiner*—Tho D. Ta
(74) *Attorney, Agent, or Firm*—Allen, Dyer, Doppelt, Milbrath & Gilchrist, P.A.

(57) ABSTRACT

The present invention relates to an electrical receptacle for a transceiver, which receives a bundle of copper wires, instead of optical fibers, for transmitting and/or receiving a plurality of parallel signals over short distances. The electrical receptacle includes an electro-magnetic interference (EMI) shield fully enclosed by the housing of the transceiver module and grounded thereto by spring fingers extending between the EMI shield and the housing. The receptacle according to the present invention enables the overall height of the transceiver module to be kept to a minimum.

11 Claims, 5 Drawing Sheets

RECEPTACLE FOR COPPER WIRE TRANSCEIVERS

CROSS-REFERENCE TO RELATED APPLICATIONS

The present invention claims priority from U.S. patent application Ser. No. 60/581,525 filed Jun. 21, 2004, which is incorporated herein by reference.

TECHNICAL FIELD

The present invention relates to an electrical receptacle for a transceiver, and in particular to an electrical receptacle with an electromagnetic interference (EMI) shield for use in short reach links, which use copper wire.

BACKGROUND OF THE INVENTION

As gigabit line rates become more prevalent in the enterprise market, the need for higher-speed aggregation uplinks is expected to grow over the next few years, which is particularly true in data communications systems in which Gigabit Ethernet is readily available on desktop computers and switches. Many integrated circuit (IC) vendors are developing new switches and media access controllers (MACs) with 10 Gigabit Ethernet ports, to provide the required higher density uplinks, thereby providing the required bandwidth and avoiding the need for multiple single gigabit ports.

The most cost-sensitive point in such a network system is inside the central office or data center, in which data transmission links are between equipment in the same room, i.e. in adjacent racks or often in the same rack. The most prevalent transmission links are inter-switch links (ISL), in which multiple switches are stacked with a single back haul to the server or another switch. Although optical solutions are usually still required to meet the distance requirements from switch room to switch room, building-to-building and central office-to-central office, there is a large opportunity for rack-to-rack or shelf-to-shelf ISL cost reduction by utilizing low cost copper cables in place of optical modules.

Currently, designers are tapping a parallel cable approach known as 10 GBASE-CX4 transceiver module, which delivers a 10-Gbit/s interconnect over a maximum span of 15 meters. CX4 is an extension of a four-channel 10-Gbit/s XAUI interface and is available in 70-pin MSA transceiver modules, e.g. Xenpak, XPAK and X2. The 10GBASE-CX4 solution employs an Infiniband-style Twin-AX cable, in which eight 100-ohm differential Twin-AX cables are bundled into a single outer shield, i.e. four channels in and four channels out. The center conductors are 24 AWG wire for compatibility with printed circuit board termination inside the connector housing.

FIG. 1 illustrates a conventional Infiniband® 4× electrical receptacle, generally indicated at 1, for mounting in a front end of a standard transceiver housing, including a connector shroud 2 and a pair of latching bars 3 (one of which is shown) extending from a rectangular body 4. An EMI shield 6 extends from around a front end of the body 4 to prevent the passage of EMI into or out of the housing of the transceiver. A compression gasket 7, in the form of spring fingers 8, extends from the front face of the EMI shield 6 for contacting a faceplate or bezel (not shown) provided on the host device. The connector shroud 2 and the latching bars 3 extend through an opening in the faceplate, while the compression gasket 7 contacts the area around the opening.

Accordingly, the EMI shield 6 must be constructed substantially larger than the connector shroud 2 and the latching bars 3 to ensure sufficient contact between the compression gasket 7 and the faceplate required to provide a proper EMI seal. Moreover, the standard receptacle 1 includes a pair of pins 9, which extends from the bottom of the body 4 to provide strain relief when soldered to plated holes in the transceiver's printed circuit board (PCB). Unfortunately, this arrangement increases the overall height of the transceiver, as the PCB must extend beside the body 4.

An object of the present invention is to overcome the shortcomings of the prior art by providing an electrical receptacle for a transceiver with a front EMI shield, which enables the overall height of the transceiver module to be reduced.

SUMMARY OF THE INVENTION

Accordingly, the present invention relates to a module for electrically connecting to a host device comprising:

a first electrical connector for receiving first and second sets of copper wires for transmitting a plurality of parallel electrical signals to and from the module, respectively, the first electrical connector including an electromagnetic interference (EMI) shield extending outwardly therefrom;

electrical circuitry for timing and synchronizing the parallel electrical signals;

a housing for supporting the electrical circuitry including a slot for receiving the EMI shield, thereby fully enclosing the EMI shield within the housing;

a second electrical connector extending outwardly from the housing for transmitting the electrical signal to and from the host device.

BRIEF DESCRIPTION OF THE DRAWINGS

The invention will be described in greater detail with reference to the accompanying drawings which represent preferred embodiments thereof, wherein.

DETAILED DESCRIPTION

Figure 1:
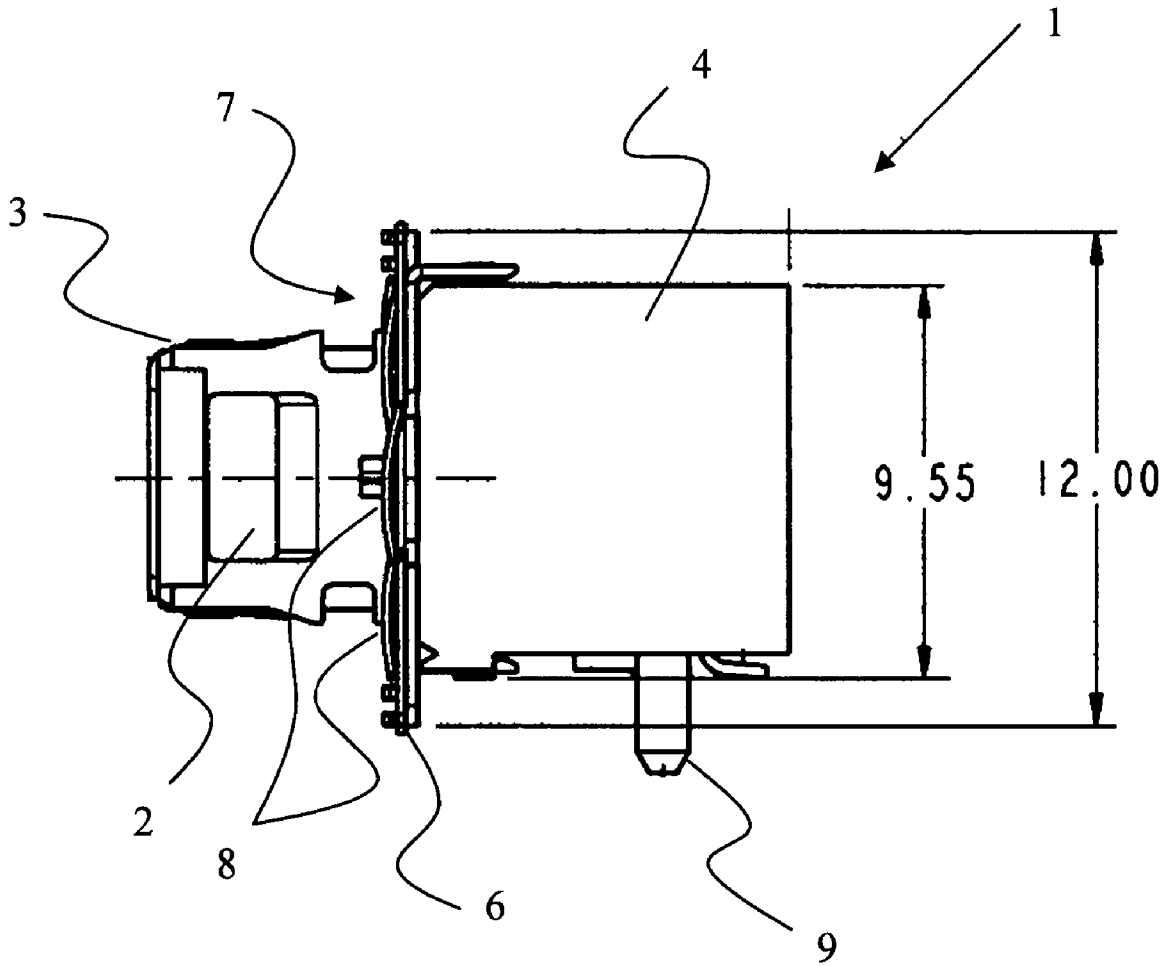
Figure 1 Prior Art
FIG. 1 is a side view of a conventional electrical receptacle for an optical transceiver.
Figure 2:
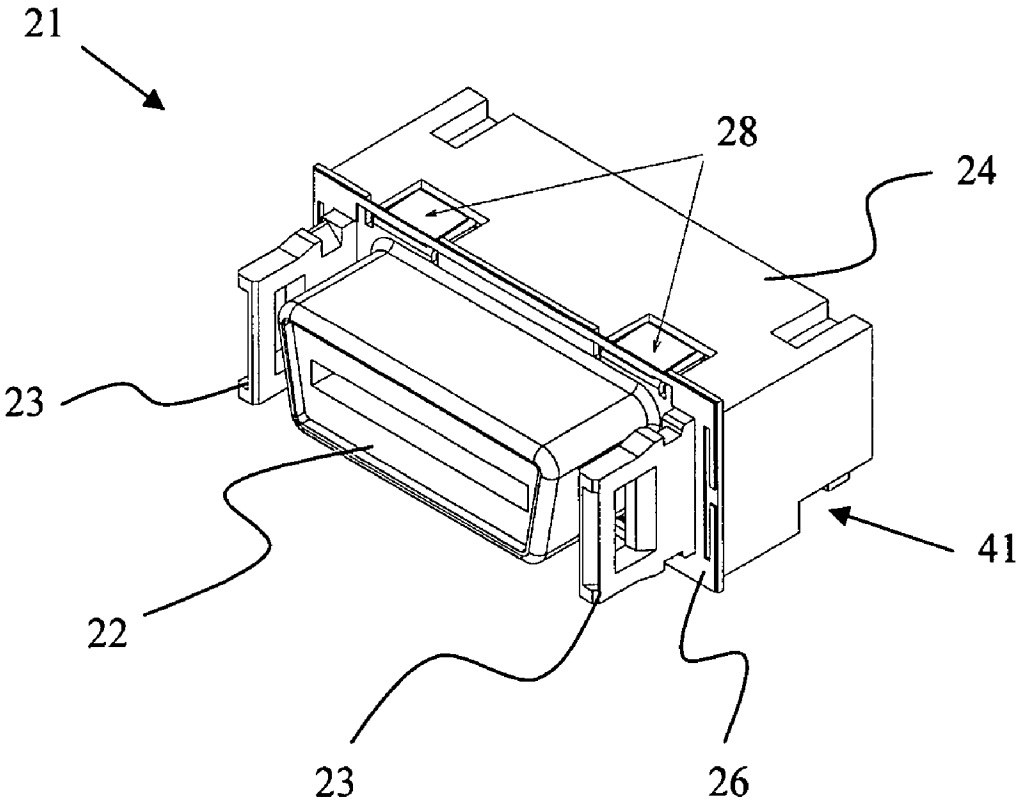
FIG. 2 is an isometric view of an electrical receptacle according to the present invention.
Figure 3:
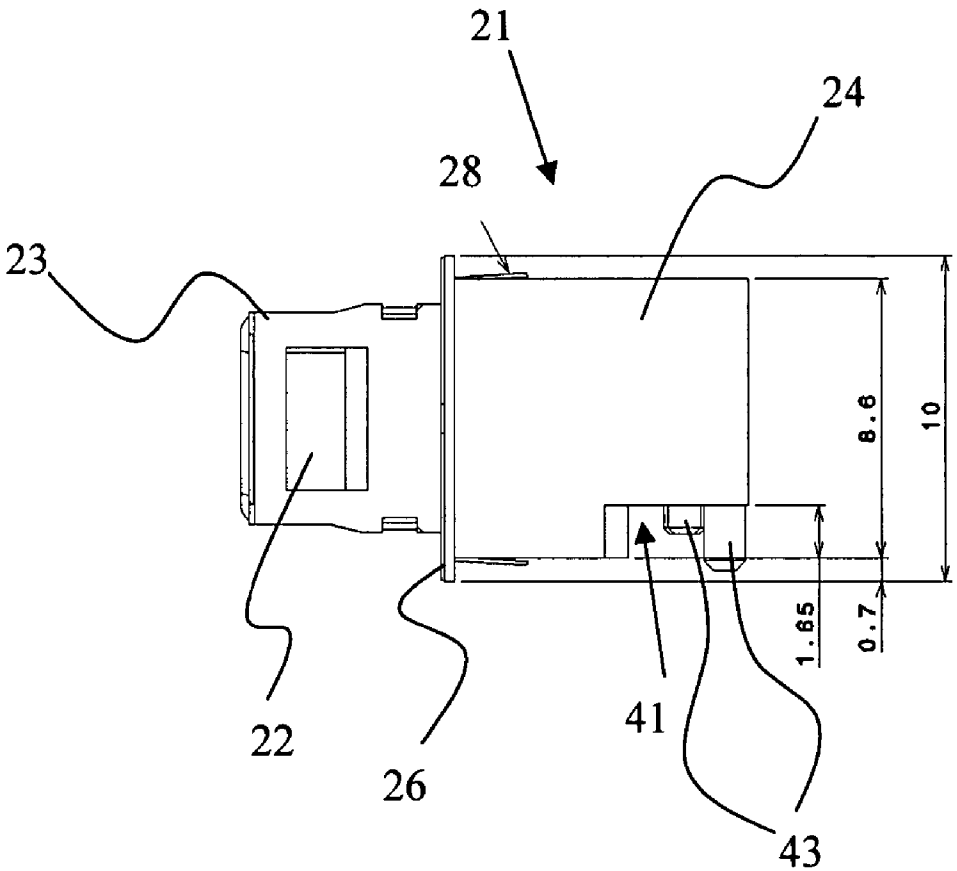
FIG. 3 is a side view of the electrical receptacle of FIG. 2.
Figure 4:
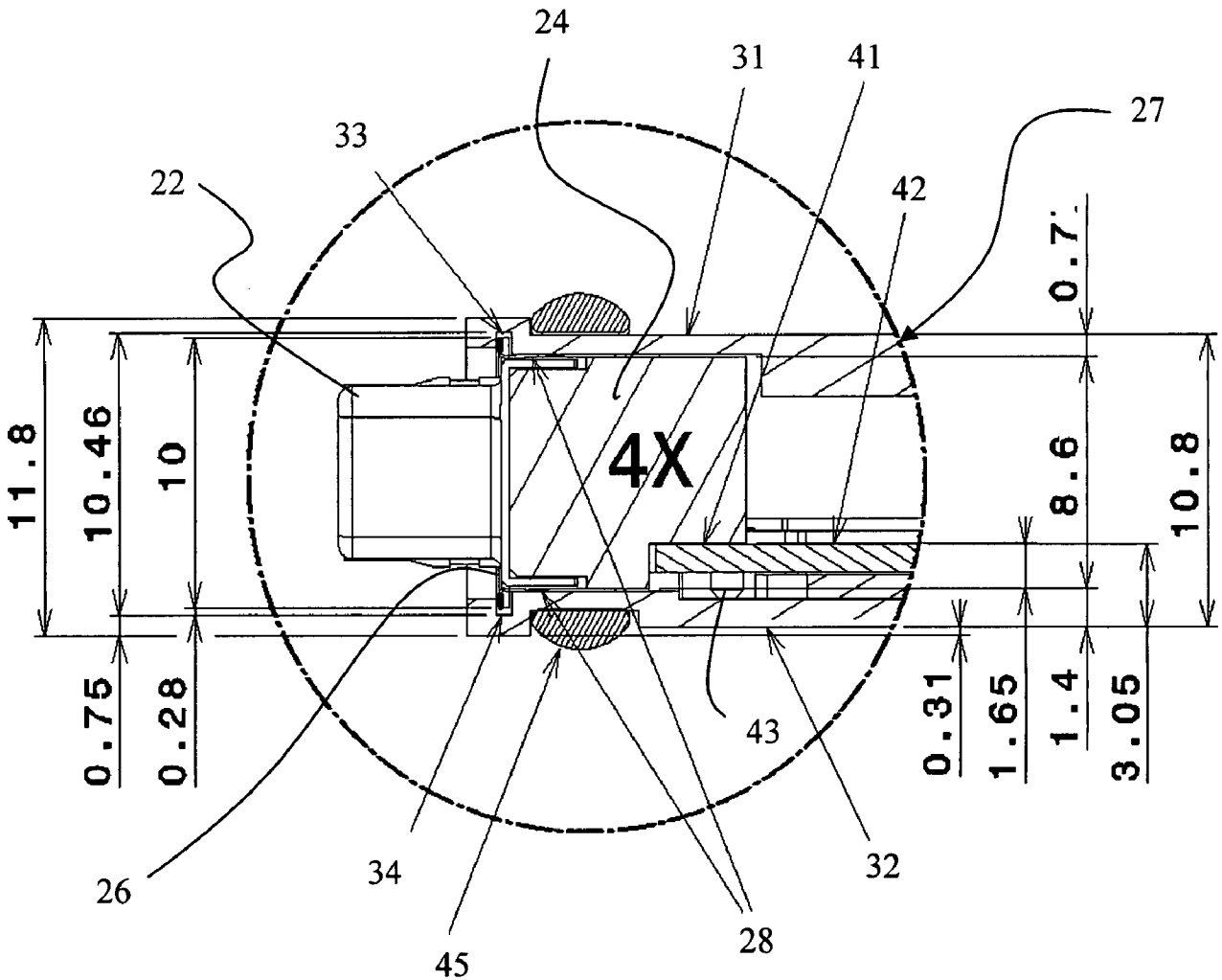
FIG. 4 is a cross-sectional view of the electrical receptacle of FIGS. 2 and 3 mounted in a transceiver housing.

With reference to FIGS. 2 to 4, an electrical receptacle according to the present invention, generally indicated at 21, includes a connector shroud 22 and a pair of latching bars 23 extending from a receptacle body 24 for mating with a standard 4× Infiniband® connector 25 (see FIG. 5) or other suitable connector. An EMI shield 26 extends from around a front end of the body 24 to prevent the passage of EMI into or out of a housing 27 of a transceiver (a portion of which is shown in FIG. 4). Grounding tabs, preferably in the form of spring fingers 28, extend rearwardly, i.e. opposite to the connector shroud 22, and slightly upwardly from the EMI shield 26 above and below the receptacle body 24 for contacting the inside walls (top and bottom) of the transceiver housing 27 to ensure a proper grounding therewith.

The transceiver housing 27 is comprised of a top cover 31 and a bottom cover 32, which fit together and sandwich the electrical receptacle 21 therebetween. Each of the top and bottom covers 31 and 32 includes a slot 33 and 34, respectively, extending around the front end thereof for receiving the ends of the EMI shield 26. Preferably, the slots 33 and 34 fully extend along the inner walls (top, side and bottom) of each of the top and bottom covers, but partially extending slots are also possible. In the illustrated embodiment, the front edges of the top and bottom covers 31 and 32 are bent upwardly and formed into U-shaped channels providing the slots 33 and 34, respectively. The slots 33 and 34 are sufficiently wide to enable the EMI shield 26 to be dropped therein during assembly, thereby fully enclosing the EMI shield 26 within housing 27. Since the EMI shield 26 could be floating in the slots 33 and 34, the additional grounding tabs 28 ensure that the EMI shield 26 is grounded to the housing 27, which is subsequently grounded to a host system by any one or more commonly known means, e.g. grounding tabs extending from the host system to the housing 27 or vice versa. Preferably, the top and bottom covers 31 and 32 form an interlocking clamshell construction, whereby the slots 33 and 34 substantially surround the EMI shield 26, but other embodiments are possible including a U-shaped bottom (or top) cover having a slot extending therearound and a flat top cover (or bottom) with a single straight slot or no slot at all.

The receptacle body 24 includes a step or a notch 41 for receiving an end of a PCB 42 mounted in the transceiver housing 27 for supporting electronic transmission and control systems for the transceiver. The opposite end of the PCB 42 includes an electrical card edge connector 44 for mating with an electrical connector provided on a PCB of the host system. Grounding pins on the card edge connector enable the transceiver module to be repeatedly hot plugged and unplugged into the host system. A 70-pin edge connector is provided in the Xenpack and X2 modules. Alternatively, the PCB 42 can be electrically connected to the host PCB via pin connectors, which are soldered to the host PCB, as is well known in the art. One or more locking pins 43 extend down from the lower surface of the receptacle body 24 into the notch 41. Plated holes are provided proximate the end of PCB 42 for receiving the locking pins 43 to facilitate mechanical connection, e.g. soldering, and alignment of the PCB 42 relative to the receptacle 21. The notch 41 enables the PCB 42 to be connected to the receptacle 21 without increasing the overall height of the transceiver. A transceiver gasket 45 can be provided to further reduce the transmission of EMI into and out of the host device.

Figure 5:
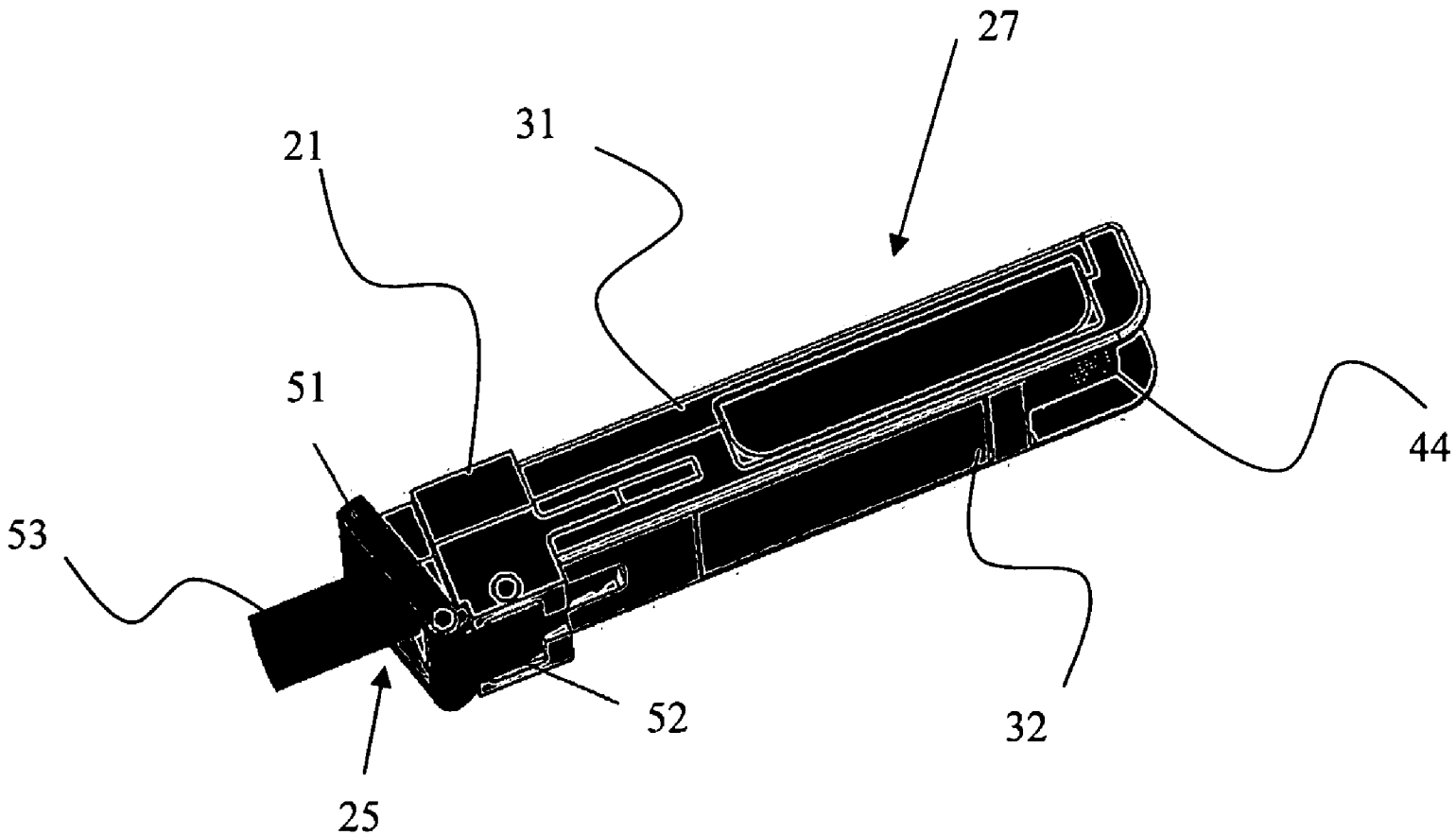
FIG. 5 is an isometric view of a transceiver module with the electrical receptacle of FIGS. 2 to 4.

With reference to FIG. 5, a pivoting bail 51 can be provided by actuating a pivoting latching bar 52 for locking and unlocking the transceiver module 27 within a cage/guide rail of the host system.

In use, an Infiniband-style Twin-AX cable 53, in which eight 100-ohm differential Twin-AX cables are bundled into a single outer shield, i.e. four channels in and four channels out, is plugged into the electrical receptacle 21 use the mating electrical connector 25. The four incoming channels are timed and synchronized and re-driven using electronic circuitry provided on the PCB 42, so that the XAUI (attachment user interface) interface of the CX4 transceiver appears as if it were any other opto-electronic transceiver, e.g. X2, Xenpak, with an effective throughput of 10 GHz.

The invention claimed is:

1. A module for electrically connecting to a host device comprising:

a first electrical connector for receiving first and second sets of copper wires for transmitting a plurality of parallel electrical signals to and from the module, respectively, the first electrical connector including an electro-magnetic interference (EMI) shield extending outwardly therefrom;

electrical circuitry for timing and synchronizing the parallel electrical signals;

a housing for supporting the electrical circuitry including a slot extending at least partially therearound for receiving the EMI shield, thereby fully enclosing the EMI shield within the housing;

a second electrical connector extending outwardly from the housing for transmitting the parallel electrical signals to and from the host device;

wherein the housing comprises a top cover and a bottom cover;

wherein each of the top and bottom covers including a slot for receiving the EMI shield.

2. The module according to claim 1, wherein the top and bottom covers are substantially the same size, whereby the slots in the top and bottom covers substantially surround the EMI shield.

3. The module according to claim 1, wherein the second electrical connector is a card edge connector hot pluggable into the host device.

4. The module according to claim 1, wherein front edges of the top and bottom covers are formed to provide the slots.

5. The module according to claim 1, further comprising grounding tabs extending from the EMI shield into contact with the housing for grounding the EMI shield thereto.

6. The module according to claim 5, wherein the grounding tabs extend in the opposite direction to the electrical connector.

7. The module according to claim 5, wherein the grounding tabs are spring bias upwardly into contact with the housing.

8. The module according to claim 1, further comprising a printed circuit board for supporting the electrical circuitry; wherein the first electrical connector further comprises a receptacle body including a notch for receiving an end of the printed circuit board, thereby reducing an overall height of the module.

9. The module according to claim 8, wherein the receptacle body further includes a connector pin extending into the notch for mechanically connecting the receptacle body to the printed circuit board.

10. The module according to claim 1, wherein the first set of copper wires includes four cables for transmitting four parallel signals to the electrical circuitry.

11. The module according to claim 10, wherein each set of copper wires includes four 100-ohm differential Twin-AX cables.

* * * * *